United States Patent [19]

Swietlik et al.

[11] 3,962,104

[45] June 8, 1976

[54] LUBRICATING OIL COMPOSITIONS

[75] Inventors: Joseph Marian Swietlik, Reading; Michael David Sexton, Oxford, both of England

[73] Assignee: Exxon Research and Engineering Company, Linden, N.J.

[22] Filed: June 24, 1974

[21] Appl. No.: 482,642

[30] Foreign Application Priority Data

June 27, 1973 United Kingdom..... 30509/73

[52] U.S. Cl...... 252/32.7 E; 252/32.7 HC; 252/33; 252/34; 252/42.7; 252/389 A; 252/391; 252/392; 252/400 A; 252/402; 252/403

[51] Int. Cl.[2]..... C10M 1/48; C10M 1/40; C10M 1/32; C10M 1/54

[58] Field of Search..... 252/32.7 HC, 33, 34, 252/42.7, 32.7 E, 392, 403, 391, 402

[56] References Cited

UNITED STATES PATENTS

| | | | |
|---|---|---|---|
| 3,428,561 | 2/1969 | Lesuer | 252/32.7 HC |
| 3,778,371 | 12/1973 | Malec | 252/34 |

*Primary Examiner*—Delbert E. Gantz
*Assistant Examiner*—I. Vaughn
*Attorney, Agent, or Firm*—Frank T. Johmann

[57] ABSTRACT

Lubricating oils containing as an ashless detergent a quaternary ammonium salt derived from an organic acid, (e.g. carboxylic acid, sulphonic acid, alkyl phenol or phosphosulphurised hydrocarbon) and a cation obtained by the reaction of a tertiary amine, olefin oxide and water.

16 Claims, No Drawings

LUBRICATING OIL COMPOSITIONS

This invention relates to lubricating oil compositions containing an ashless detergent.

It has been found that certain quaternary ammonium salts when added to crankcase lubricants behave as very effective ashless detergents.

According to this invention crankcase lubricating oil compositions comprise a mineral or synthetic lubricating oil and a quaternary ammonium salt wherein the cation is derived from the reaction product of a tertiary amine with an olefin oxide and water.

The quaternary ammonium salts can be made in two stages:

In the first stage a tertiary amine is reacted with an olefin oxide in the presence of excess water to yield a solution of a quaternary ammonium hydroxide.

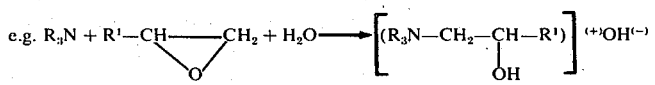

In the second stage a quaternary ammonium hydroxide is neutralised with an organic acid to form a quaternary ammonium salt, i.e.

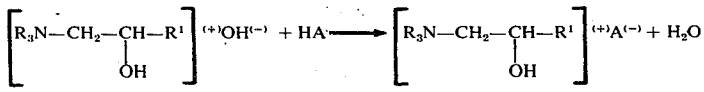

The tertiary amines which are suitable include i. amines of the formula $R^1R^2R^3N$ where $R^1$, $R^2$ and $R^3$ which may be the same or different are alkyl, cycloalkyl, alkenyl, cycloalkenyl, substituted alkyl and alkenyl groups or aromatic and substituted aromatic groups. Each of the groups $R^1$, $R^2$ and $R^3$ preferably have 1 to 20 carbon atoms. Examples of this type of amine are trimethyl amine, ethyl dimethylamine, n-propyldimethylamine, triethanolamine, N,N dimethyl benzyl amine, N,N dimethyl cyclohexylamine and N,N dimetylaniline.

ii. diamines of the formula $R^4R^5N\ (CH_2)_nNR^6R_7$ where n is an integer of one or more, and $R^4$, $R^5$, $R^6$ and $R^7$ which may be the same or different are alkyl, substituted alkyl, cycloalkyl, alkenyl, cycloalkenyl, aromatic or substituted aromatic. Thus, one may use $NNN^1N^1$ tetramethyl ethylene diamine.

iii. fully alkylated alkylene polyamines of the formula

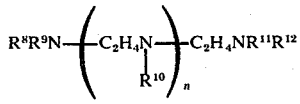

where $n$ is an integer of one or more and $R^8$, $R^9$, $R^{10}$, $R^{11}$ and $R^{12}$ which may be the same or different are the same as $R^4$ above.

iv. pyridine and substituted pyridines, e.g. $\alpha,\beta$ and $\gamma$ picolines, quinoline and substituted quinolines and similar heterocyclic tertiary amines.

v. substituted piperidines of the formula

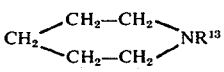

where $R^{13}$ is the same as $R^4$ above.

vi. N-substituted pyrrolidines of the formula

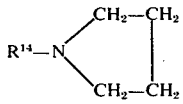

where $R^{14}$ is the same as $R^4$ above.

vii. N-substituted morpholines

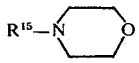

where $R^{15}$ is the same as $R^4$ above.

viii. amines of the formula

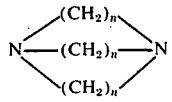

where $n$ is an integer of two or more, e.g. triethylene diamine.

ix. hexamethylene tetramine $(CH_2)_6N_4$ (hexamine).

Generally the reaction is applicable to olefin oxides of the formula

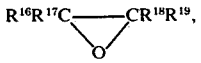

where $R^{16}$, $R^{17}$, $R^{18}$, and $R^{19}$ which may be the same or different, are hydrogen, alkyl, cycloalkyl, alkenyl, cycloalkenyl, aromatic or substituted aromatic group. Specific examples are ethylene oxide, propylene oxide, but-1-ene oxide, but-2-ene oxide, oct-1-ene oxide and styrene oxide.

The organic acid which is used in the second stage of the reaction include carboxylic acids, carboxylic acid anhydrides, dialkyldithiophosphoric acids, diaryldithiophosphoric acids, phenols, sulphurised phenols, sulphonic acids and the acids and the anhydrides resulting from the reacton of an olefin with phosphorus sulphides.

The carboxylic acids include:

i. Acids of the type

R - COOH where R is hydrogen, alkyl, cycloalkyl, alkenyl, cycloalkenyl, aromatic or substituted aromatic group. Examples of such acids include formic acid, acetic acid, propionic acid, butyric acid, valeric acid, palmitic acid, stearic acid, cyclohexanecarboxylic acid, 2-methylcyclohexanecarboxylic acid, 4-methylcyclohexane carboxylic acid, oleic acid, linoleic acid, linolenic, cyclohex-2-eneoic acid, benzoic acid, 2-methylbenzoic acid, 3-methylbenzoic acid, 4-methylbenzoic acid, salicylic acid, 2-hydroxy-4-methylbenzoic acid, 2-hydroxy-4-ethylsalicylic acid, p-hydroxybenzoic acid, 3,5,-di-ti-butyl-4-hydroxybenzoic acid, o-aminobenzoic acid, p-aminobenzoic acid, o-methoxybenzoic acid and p-methoxybenzoic acid.

ii. Dicarboxylic acids of the type:

$$HOOC - (CH_2)_n - COOH$$

where $n$ is zero or an integer — including oxalic acid, malonic acid, succinic acid, glutaric acid, adipic acid, pimelic acid, suberic acid etc. Also included are acids of of the type:

$$HOOC-(CH_2)x-\overset{\overset{R}{|}}{C}H-(CH_2)y-COOH$$

where $x$ is zero or an integer, $y$ is zero or an integer and $x$ and $y$ may or may not be equal and R is defined as in (i). Examples of such acids include the alkyl or alkenyl succinic acids, 2-metylbutane dioic acid, 2-ethylpentanedioic acid, 2-n-dodecylbutanedioic acid, 2-n-dodecenylbutanedioic acid, 2-phenylbutanedioic acid, 2-(p-methylphenyl) butanedioic acid. Also included are polysubstituted alkyl dicarboxylic acids wherein other R groups as described above may be substituted on the alkyl chain. These other groups may be substituted on the same carbon atom or different atoms. Such examples include 2,2-dimethylbutanedioic acid; 2,3-dimethylbutanedioic acid; 2,3,4 trimethylpentanedioic acid; 2,2,3-trimethylpentanedioic acid; 2-ethyl-3-methylbutanedioic acid etc.

The dicarboxylic acids also include acids of the type $$HOOC - (C_nH_{2n}-2) - COOH$$

where $n$ is an integer. Examples include maleic acid, fumaric acid, pent-2-enedioic acid, hex-2-enedioic acid; hex-3-endioic acid; 5-methylhex-2-enedioic acid; 2,3-dimethylpent-2-enedioic acid; 2-methylbut-2-enedioic acid, 2-dodecylbut-2-enedioic acid; 2-polyisobutylbut-2-enedioic acid etc.

The dicarboxylic acids also include aromatic dicarboxylic acids e.g. phthalic acid, isophthalic acid, terephthalic acid and substituted phthalic acids of general type:

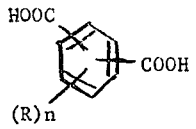

where R as defined (i) and $n$ = 1,2,3, or 4 but when $n>1$ then the two R groups may be similar or different. Examples of such acids include 3-methylbenzene-1,2,-dicarboxylic acid; 4-phenylbenzene-1,3-dicarboxylic acid; 2-(1-propenyl) benzene-1,4-dicarboxylic acid; 3,4-dimethylbenzene-1,2-dicarboxylic acid etc.

The carboxylic acid anhydrides include the anhydrides that may be derived from the carboxylic acids described above. Also included are the anhydrides that may be derived from a mixture of any of the carboxylic acids described above. Specific examples include acetic anhydride, propionic anhydride, benzoic anhydride, maleic anhydride, succinic anhydride, didecylsuccinic anhydride, dodecenylsuccinic anhydride, polyisobutylenesuccinic anhydride, phthalic anhydride, 4-methylphthalic anhydride.

The dialkyldithiophosphoric acids and diaryldithiophosphoric acids include products of the formula:

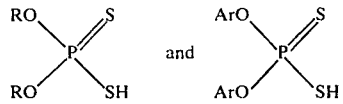

where R is an alkyl, cycloalkyl, alkenyl or cycloalkenyl group and Ar is an aromatic or substituted aromatic group. The total number of carbon atoms in the R or Ar group may be from 1–80 but the preferred number is 4–20. The acids which may be made by the reaction of any alcohol or phenol with phosphorus pentasulphide include as specific examples: dimethyldithiophosphoric acid; diethyldithiophosphoric acid, di-n-propyldithiophosphoric acid; di-n-butyldithiophosphoric acid; di-sec-butyldithiophosphoric acid, di-iso-butyldithiophosphoric acid; di-t-butyldithiophosphoric acid, diphenyldithiophosphoric acid; di(p-methylphenyl) dithiophosphoric acid; di (o-methylphenyl)dithiophosphoric acid; di(p-nonylphenyl) dithiophosphoric acid; di(p-dodecylphenyl) dithiophosphoric acid etc.

The phenols from which the anion of the quaternary ammonium result may be derived are of many different types. Examples of suitable phenols include:

i. Phenols of the type

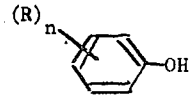

where $n$ = 1,2,3,4 or 5 where R is defined below and when $n<1$ then the substituents may be the same or different. R may be hydrogen, alkyl, cycloalkyl, alkenyl, cycloalkenyl, aromatic or substituted aromatic. Alternatively the hydrocarbon group(s) may be bonded to the benzene ring by a keto or thio-keto group. Alternatively the hydrocarbon group(s) may be bonded through an oxygen sulphur or nitrogen atom. Examples of such phenols include o-cresol; m-cresol; p-cresol; 2,3-dimethylphenol; 2,4-dimethylphenol; 2,3,4 trimethylphenol 3-ethyl-2,4-dimethyl-phenol; 2,3,4,5-tetramethylphenol; 4-ethyl-2,3,5,6-tetramethylphenol; 2-ethyl phenol; 3-ethylphenol; 4-ethylphenol; 2-n-propylphenol; 2-isopropylphenol; 2-isopropylphenol; 4-n-butylphenol; 4-isobutylphenol; 4-secbutylphenol; 4-t-butylphenol; 4-nonylphenol; 2-dodecylphenol; 4-dodecylphenol; 4-octadecylphenol; 2-cyclohexylphenol; 4-cyclohexylphenol; 2-allylphenol; 4-allylphenol; 2-hydroxydiphenyl; 4-hydroxydiphenyl; 4-methyl-4′-hydroxydiphenyl; o-methoxyphenol; p-methoxyphenol; p-phenoxyphenol; 2-hydroxydiphenylsulphide; 4-hydroxydiphenylsulphide; 4-hydroxyphenyl methyl sulphide; 4-hydroxyphenyldimethylamine etc. Also included are alkyl phenols where the alkyl group is obtained by polymerisation of a low molecular weight olefin e.g. polypropylphenol, polyisobutylphenol etc.

Also included are phenols of the type:

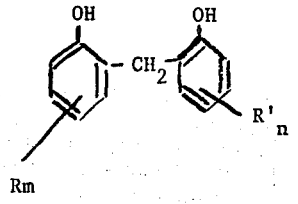

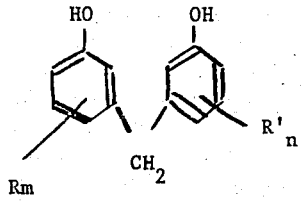

and

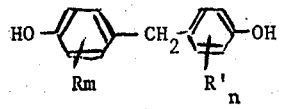

where R and R′ which may be the same or different are as defined above and *m* and *n* are integers. Examples of such phenols include 22′-dihydroxy-55′-dimethyldiphenylmethane; 55′-dihydroxy-22′-dimethyldiphenylmethane; 44′-dihydroxy-22′-dimethyldiphenylmethane; 22′-dihydroxy-55′-dinonyldiphenylmethane; 22′-dihydroxy-55′-didodecyldiphenylmethane; 22′44′-tetra-t-butyl-33′dihydroxydiphenylmethane etc.

Also included are sulphurised phenols of the type

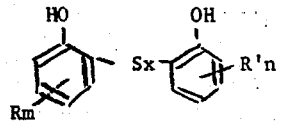

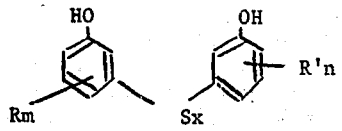

and

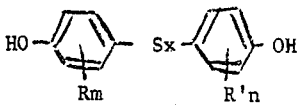

where R and R′ which may be the same or different are as defined above, and *m* and *n* are integers and *x* is 1,2,3 or 4. Examples of such phenols include: 22′ dihydroxy-55′ dimethyldiphenylsulphide, 55′-dihydroxy-22′-di-t-butyldiphenyldisulphide; 44′-dihydroxy-33′-di-t-butylphenyl sulphide; 22′-dihydroxy-55′-dinonyldiphenyldisulphide; 22′-dihydroxy-55′-didodecyldiphenyldisulphide; 22′-dihydroxy-55′-didodecyldiphenyltrisulphide; 22′-dihydroxy-55′-didodecyldiphenyltetrasulphide etc.

The sulphonic acids from which the anion of the quaternary ammonium salt can be derived include alkyl and aryl sulphonic acids which may have a total of 1–200 carbon atoms per molecule although the preferred range is 10–80 atoms per molecule. Included in this description are aryl sulphonic acids of the type

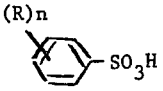

where $n = 1,2,3,4,5$ and when $n > 1$ the substituents may be the same or different.

R is hydrogen, alkyl, cycloalkyl, alkenyl, cycloalkenyl, aryl or a substituted aryl group. Alternatively the hydrocarbon group(s) may be bonded to the benzene ring through a carbonyl group or the thio-keto group. Alternatively the hydrocarbon group(s) may be bonded to the benzene ring through a sulphur, oxygen, or nitrogen atom. Thus examples of sulphonic acids that may be used include: benzene sulphonic acid; o-toluenesulphonic acid; m-toluenesulphonic acid; p-toluenesulphonic acid; 2,3-dimethyl-benzenesulphonic acid; 2,4-dimethylbenzenesulphonic acid; 2,3,4-trimethylbenzenesulphonic acid; 4-ethyl-2,3-dimethylbenzenesulphonic acid; 4-ethylbenzenesulphonic acid; 4-n-propylbenzenesulphonic acid; 4-n-butylbenzenesulphonic acid; 4-iso-butylbenzenesulphonic acid; 4-sec-butylbenzenesulphonic acid; 4-t-butylbenzenesulphonic acid; 4-nonylbenzenesulphonic acid; 2-dodecylbenzenesulphonic acid; 4-dodecylbenzenesulphonic acid; 4-cyclohexybenzenesulphonic acid; 2-cyclohexylbenzenesulphonic acid; 2-allylbenzenesulphonic acid; 2-phenylbenzenesulphonic acid; 4(4′methylphenyl)-benzenesulphonic acid; 4 methylmercaptobenzenesulphonic acid; 2-methoxybenzene sulphonic acid; 4 phenoxybenzenesulphonic acid; 4 methylaminobenzenesulphonic acid; 2-dimethylaminobenzenesulphonic acid; 2 phenylaminobenzene sulphonic acid, etc. Also included are sulphonic acids of the type listed above wherein R is derived from the polymerisation of a low molecular weight olefin e.g. polypropylbenzene sulphonic acid and polyisobutylenebenzenesulphonic acid.

Also included are sulphonic acids of the type:

$R\text{-}SO_3H$ where R is alkyl, cycloalkyl, alkenyl or cycloalkenyl. Examples of sulphonic acids of this type that may be used include, methylsulphonic acid; ethylsulphonic acid; n-propylsulphonic acid; n-butylsulphonic acid; isobutylsulphonic acid; sec-butylsulphonic acid; t-butylsulphonic; nonylsulphonic acid; dodecylsulphonic acid; polypropylsulphonic acid; polyisobutylsulphonic acid; cyclohexysulphonic acid; 4-methycyclohexylsulphonic acid etc.

The phosphosulphurised hydrocarbon from which the anion of the quaternary ammonium salt can be derived are the acids and anhydrides formed by the reaction of an olefin with phosphorus trisulphide or phosphorus pentasulphide. Thus these products may be derived from propene, butene, isobutene, the pentenes, hexenes, heptenes, octenes, nonenes, decenes, dodecenes, octadecenenes etc.

Alternatively one may use cyclic olefins such as cyclohexene, cyclopentene, cycloheptene and substituted cyclic olefins such as 3-methylcyclohexene, 4-ethylcyclohexene etc. Alternatively the olefin may be a polymeric product derived from a $C_2$–$C_5$ olefin. Especially suitable are the polybutenes, such as polyisobutylene, particularly when the molecular weight is in the range 500–1500.

Alternatively the olefin may be a naturally occurring product such as a terpene or similar. Examples of suitable olefins include $\alpha$-pinene; $\beta$-pinene, $\alpha$-terpinene, $\beta$-terpinene, $\gamma$-terpinene, limonene, etc.

The quaternary ammonium salts can be made in two stages, the first stage of which comprises a tertiary amine with an olefin oxide.

Generally 1 mole of the tertiary amine is reacted with '*a*' moles of the olefin oxide (where '*a*' is the number of tertiary nitrogens in the amine molecule) in the presence of an excess of water over that required by the stoicheiometry of the reaction.

Thus pyridine (1 mole) is reacted with an olefin oxide (1 mole) in water (>1 mole). Triethylenediamine (1 mole) is reacted with an olefin oxide (2 moles) in water (>2 moles). Hexamine (1 mole) is reacted with an olefin oxide (4 moles) in water (>4 moles).

However, an excess of the olefin oxide can be used if required, the excess olefin oxide then reacts with the quaternary ammonium hydroxide. One possible mechanism for this further reaction with olefin oxide is illustrated by the equations:

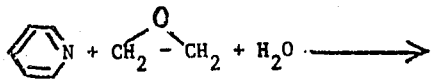

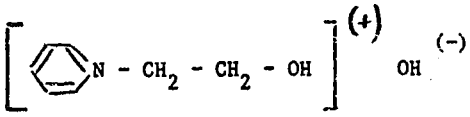

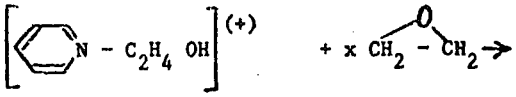

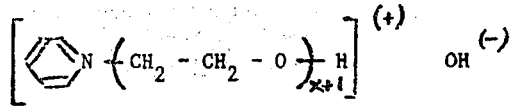

As indicated above any amount of water can be used as long as it represents an excess over that required by the stoicheiometry of the reaction.

The reaction can be carried out in the following ways:

i. The amine is stirred with the olefin oxide in the reactor and the water added to the reaction mixture. The rate of addition of the water does not affect the quality of the final product but slow addition of water can be used to control an exothermic reaction.

ii. The amine is mixed with the water in the reactor and the olefin oxide is added to the stirred reaction mixture. The olefin oxide can be added:

a. As a gas either pure or diluted with an inert carrier (e.g. nitrogen)

b. As a liquid c. As a solution in water d. As a solution in a water soluble organic solvent (e.g. methyl alcohol, ethyl alcohol, etc.).

The rate of addition of the olefin oxide is not critical for the quality of the final product but a slow addition rate can be used to control an exothermic reaction.

iii. The olefin oxide is mixed with the water in the reactor and the amine is added to the reaction mixture. The amine can be added:

a. As a pure gas, liquid, or solid.

b. As a solution in water.

c. As a solution in a water soluble organic solvent.

As with the olefin oxide and water addition, slow addition of the amine can be used to control an exothermic reaction.

To facilitate the reaction the reactants when mixed are heated. Alternatively two of the reactants can be heated together at a given temperature while the third reactant is added at a rate sufficient to maintain a steady reaction. Alternatively the reactants can be heated in a pressure vessel and when heating the reactants to promote the reaction, temperatures greater than 100°C should be avoided to prevent decomposition of the quaternary ammonium hydroxide.

The second stage of the reaction comprises neutralisation of the quaternary ammonium hydroxide formed in the first stage with the organic acid.

Generally sufficient acid is mixed with the solution obtained from the first stage to neutralise the quaternary ammonium hydroxide. However, an excess of acid may be used if required as for example when only one carbonyl group of a polybasic carboxylic acid is to be neutralised. The neutralisation reaction can be carried out:

i. In the absence of any solvent ii. In the presence of an alcohol, e.g. methanol, ethanol, isopropanol, ethyl cellusolve, and ethylene glycol.

iii. In the presence of any other polar organic solvent, e.g. acetone, methyl ethyl ketone, chloroform, carbon tetrachloride, or sym-tetrachloroethane iv. In the presence of a hydrocarbon solvent, e.g. hexane, heptane, white spirit, benzene, toluene or xylene.

v. In the presence of a mixture of any of the above solvents.

The neutralisation reaction can be carried out at ambient temperature but generally an elevated temperature is used. When the reaction is complete the water and any solvents used are removed by heating and application of a vacuum. The product is generally diluted with mineral oil to prevent the product being too viscous.

The quaternary ammonium salts described above are added to a lubricating oil to form a crank case lubricant. The lubricating oil can be any animal, vegetable or mineral oil, for example, petroleum oil fractions ranging from naphthas to spindle oil to SAE 30, 40 or 50 lubricating oil grades.

Alternatively, the lubricating oil can be a synthetic oil, e.g. a synthetic ester oil. Suitable synthetic ester oils include diesters such as dioctyl adipate, dioctyl sebacate, didecyl azelate, tridecyl adipate, didecyl succinate, didecyl glutarate and mixtures thereof. Alternatively, the synthetic ester can be a polyester such as that prepared by reacting polyhydric alcohols such as trimethylol propane and pentaerythritol with monocarboxylic acids such as butyric acid, caproic acid, caprylic acid and pelargonic acid to give the corresponding tri- and tetra- esters. Also a complex ester such as that formed by esterification reactions between a dicarboxylic acid, a glycol and an alcohol and/or a monocarboxylic acid, may be used.

The quaternary ammonium salt is preferably included in the lubricating oil as a minor proportion by weight, e.g. 0.001 to 10.0% by weight, more preferably 0.1 to 5.0% by weight based on the weight of lubricating oil.

The quaternary ammonium salts described are essentially ashless equivalents of metal containing additives. These additives are designed for use in lubricating oils where low ash content is desirable. Thus suitable quaternary ammonium salts may be expected to act as dispersants, detergents, antioxidants, antiwear agents, antirust additives, etc. Examples of the use of quaternary ammonium salts are given below:

EXAMPLE 1

Pyridine (79g 1 mole) was heated under reflux with propylene oxide (58g 1 mole) and water (36g 2 moles) until the reflux temperature of the reaction mixture reached 90°C. The reaction mixture was maintained at 90°C for 1 hour and then added to a solution of polyisobutylenesuccinic anhydride (255g, made from 960 molecular weight polyisobutylene and maleic anhydride) in toluene (193g 200 ccs) and methanol (158g 200 ccs). The reaction mixture was heated to reflux for 3 hours and then stripped to 150°C/60mm Hg. Mineral oil* (140g) was added to the residue which was then filtered through a diatomaceous earth to give a black, bright, mobile product.

* Paraffinic base oil with viscosity 150 SSU at 100°F.

TBN (Castrol Method) = 45 mgs.KOH/g
TAN (D664/IP 177 ) = 5.3 mgs.KOH/g

EXAMPLE 2

Pyridine (79g 1.0 moles) propylene oxide (58g 1.0 moles) and water (36g 2.0 moles) were heated to reflux until the reaction temperature reached 90°C. After maintaining the reaction mixture at 90°C for 30 mins. it was added to a solution of dodecylphenol (262g 1 mole) in toluene (96.5g 100ccs) and methanol (158g 200 ccs). The reaction mixture was heated to reflux for 1 hour and then the solvents were removed by heating to 150°C/100mm Hg. Mineral oil (166g) was added to the residue which was then filtered through diatomaceous earth.

TBN (Castrol Method) = 52 mgsKOH/g
TAN (D644/IP177 ) = NIL

EXAMPLE 3

Tetramethylethylenediamine (58g 0.5 moles) was heated to reflux with propylene oxide (58g 1 mole) and water (36g 2 moles). After 30 minutes the reaction temperature reached 90°C. The reaction mixture was held at 90°C for a further 30 minutes and then the solution was added to dodecyl phenol (262g 1 mole) in toluene (150 ccs) and methanol (150 ccs). The reaction mixture was heated to reflux for 2½ hours then the solvents removed by heating to 170°C/100mm Hg. Mineral oil (90g) was added to the residue which was then filtered through diatomaceous earth to give a bright, mobile product.

TBN (Castrol Method) = 68 (mgs.KOH/g)
TAN (D664/IP 177) = NIL

EXAMPLE 4

Tetramethylethylenediamine (58g 0.5 moles), propylene oxide (58g 1 mole) and water (36g 2 moles) were heated to reflux until the reaction temperature reached 90°C. The reaction mixture was maintained at 90°C for 30 minutes and then added to a solution of nonylphenol sulphide (396g, effective molecular weight 792) in toluene (100 ccs) and methanol (100 ccs). The reaction mixture was heated to reflux for 2 hours and then the solvents and water were removed by heating to 150°C/60 mm Hg. The residue was filtered through a diatomaceous earth to give a bright, black product.

TBN (Castrol Method) = 34 mgs.KOH/g
TAN (D664/IP 177) = 25mgs.KOH/g

EXAMPLE 5

Triethylenediamine (56g 0.5 moles) was mixed with propylene oxide (58g 1 mole) and water (36g 2 moles). There was a vigorous exothermic reaction. When the reflux subsided the reaction mixture was heated to 80°C. The reaction mixture became very viscous and water (50g) was added. Reaction mixture was maintained at 80°C for 30 minutes and then added to a solution of dodecylphenol (262 g 1 mole) in methanol (100 ccs) and toluene (100 ccs). The reaction mixture was heated to reflux for 2 hours and then the solvents and water were removed by heating to 150°C/100 mm Hg. Mineral oil (100g) was added to the product which was then filtered through diatomaceous earth.

TBN (Castrol Method) = 118 mgs.KOH/g
TAN (D664/IP 177) = NIL

EXAMPLE 6

Hexamethylenetetramine (35g 0.25 moles) was mixed with propylene oxide (58g 1 mole) and water (50g 2.78 moles). There was an exothermic reaction and the reaction mixture refluxed steadily. When the reflux subsided the reaction mixture was heated to 80°C and then added to a solution of dodecylphenol (262g 1 mole) in toluene (100 ccs) and methanol (100 ccs). The reaction mixture was heated to reflux for 1½ hours and then the solvents and water were removed by heating to 150°C/60mm Hg. Mineral oil (85g) was added to the product which was then filtered through a diatomaceous earth to give a clear yellow, mobile product.

TBN (Castrol Method) = 103mgs.KOH/g
TAN (D664/IP 177) = 2.4 mgs.KOH/g

EXAMPLE 7

Hexamethylenetetramine (35g 0.25 moles) was dissolved in water (100g 5.6 moles). Propylene oxide (58g 1 mole) was slowly added to the reaction mixture with stirring. There was an exothermic reaction and the temperature of the reaction mixture rose to 80°C but there was no reflux. When addition of the propylene oxide was complete the reaction mixture was maintained at 80°C for 30 minutes and then added to a solution of dodecylphenol (262g 1 mole) in toluene (100 ccs) and methanol (100 ccs). The reaction mixture was heated to reflux for 2 hours. Then the solvents and water were removed by heating to 150°C/100mm Hg. Mineral oil (88g) was added to the product which was then filtered through a diatomaceous earth.

TBN (Castrol Method) = 96.4 mgs.KOH/g
TAN (D664/IP177) = NIL

EXAMPLE 8

Hexamethylenetetramine (35g 0.25 moles) was stirred with water (50g 2.8 moles) and then a solution of propylene oxide (58g 1 mole) in water (100g 5.6 moles) added over a period of 1 hour. During the addition of the propylene oxide solution there was an exothermic reaction, and the temperature of the reaction mixture rose to 80°C, but the reaction mixture did not reflux. When the addition of the propylene oxide was complete the reaction mixture was maintained at 80°C for 30 minutes and then added to a solution of dodecylphenol (262g 1 mole) in toluene (100 ccs) and methanol (100 ccs). The reaction mixture was heated to reflux for 2 hours, and then heated to 150°C/100mm Hg. to remove the solvents and water. Mineral oil (88g) was added to the residue which was then filtered through diatomaceous earth.

TBN (Castrol Method) = 97.7mgs.KOH/g
TAN (D664/IP 177) = NIL

EXAMPLE 9

Hexamethylenetetramine (35g 0.25 moles) was dissolved in water (150g 8.35 moles) and the solution heated to 50°C. Propylene oxide (58g 1 mole) was added to the solution as a gas by passing a mixture of propylene oxide vapour and nitrogen through the solution. When addition of the propylene oxide was complete the reaction mixture was heated to 80°C for 30 minutes and then added to a solution of dodecylphenol (262g 1 mole) in toluene (100 ccs) and methanol (200 ccs). The reaction mixture was heated to reflux for 2 hours and then the solvents removed by heating to 150°C/100mm Hg. Mineral oil (88g) was added and the product was filtered through a diatomaceous earth.

TBN (Castrol Method) = 91.1 mgs.KOH/g
TAN (D664/IP 177) = NIL

EXAMPLE 10

Propylene oxide (58g 1 mole) was dissolved in water (100g 5.6 moles). A solution of hexamethylenetetramine (35g 0.25 moles) in water (50g 2.8moles) was added slowly. An exothermic reaction took place and the temperature of the reaction mixture rose to 70°C with some reflux of the reaction mixture. When the addtion of the hexamine solution was complete the reaction mixture was heated to 80°C for 30 minutes and then added to a solution of dodecylphenol (262g 1 mole) in toluene (100 ccs) and methanol (100 ccs). Reaction mixture was heated to reflux for 2 hours and then stripped to 150°C/100 mm Hg. to remove the solvents and water. Mineral oil (88g) was added and the product filtered through a diatomaceous earth.

TBN (Castrol Method) = 96.3 mgs.KOH/g
TAN (D664/IP 177) = NIL

EXAMPLE 11

Hexamethylenetetramine (70g 0.5 moles) was dissolved in water (200g 11.1 moles). Propylene oxide (116g 2 moles) was added slowly over 1½ hours. There was a mild exothermic reaction and the reaction temperature rose to 80°C without reflux. When the propylene oxide addition was complete the reaction mixture was maintained at 80°C for 30 minutes. Then dodecylphenol (524g 2 moles) was added to the reaction mixture and the temperature kept at 80°C for 1 hour. Then the temperature was raised to 150°C and the water removed from the reaction mixture by using a nitrogen sparge and vacuum (20mm Hg). Mineral oil (176g) was added to the residue which was then filtered through a diatomaceous earth.

TBN (Castrol Method) = 98.0 mgKOH/g
TAN (D664/IP 177) = NIL

EXAMPLE 12

Hexamethylenetetramine (140g 1 mole) was dissolved in water (144g 8 moles). The solution was heated to 55°C and ethylene oxide (181g 4.1 moles) was passed into the solution over 5 hours. There was an exothermic reaction and the temperature of the reaction mixture increased to 90°C. The final product was a dark, bright, viscous solution.

EXAMPLE 13

Dodecylphenol (262g 1 mole) was mixed with a portion of the solution from Example 12 (115 g calculated 0.25 moles of hexamine), toluene (100 ccs) and methanol (100 ccs). The reaction mixture was heated to reflux for 2 hours and then stripped to 150°C/100 mm Hg. to remove the solvents and water. Mineral oil (85.5g) was added to the residue which was then filtered through a diatomaceous earth.

TBN (Castrol Method) = 89mgs.KOH/g

EXAMPLE 14

Sulphonic acid (315g, a mixed alkylbenzenesulphonic acid of 630 MW) was mixed with a portion of the solution from Example 12 (133g) toluene (100ccs) and methanol (100 ccs). The reaction mixture was heated to reflux for 2 hours and then the solvents and water were removed by heating to 150°C/100mm Hg. Mineral oil (58g) was added to the residue which was then filtered through a diatomaceous earth.

TBN (Castrol Method) = NIL
SAN (D664/IP 177) = NIL

EXAMPLE 15

Hexamethylenetetramine (35g 0.25 moles) was mixed with propylene oxide (116g 2 moles) and water (36g. 2 moles). The reaction mixture was heated to reflux for 7½ hours after which the reaction temperature was 85°C. The reaction mixture was added to a sulphonic acid (350g a mixed alkylbenzenesulphonic acid of 700 MW) in toluene (100 cc) and methanol (100 cc). The reaction mixture was heated to reflux for 2 hours and then the solvents and water were removed by heating to 150°C/100mm Hg. The residue was filtered through a diatomaceous earth.

TBN (Castrol Method) = 16.9 mg.KOH/g
SAN (D664/IP 177) = NIL

EXAMPLE 16

Hexamethylenetetramine (35g 0.25 moles) was mixed with styrene oxide (120g 1 mole) and water (50g 2.8 moles). The reaction mixture was heated to 50°C when an exothermic reaction took place and the temperature rose rapidly to 90°C. Reaction mixture maintained at 90°C for 4 hours and then added to a solution of dodecylphenol (262g 1 mole) in toluene (100 ccs) and methanol (100 ccs). The reaction mixture was heated to reflux for 2 hours and then stripped of the solvents and water by heating to 150°C/100mm Hg. Mineral oil (105g) was added to the residue which was then filtered through diatomaceous earth.

TBN (Castrol Method) = 89.2 mg.KOH/g
TAN (D664/IP 177) = 4.4 mg.KOH/g.

Examples of the use of quaternary ammonium compounds are given below:

EXAMPLE 17 i. An ashless multigrade oil comprised of the following:

a. A conventional polyisobutylenesuccinic anhydride/polyamine product as dispersant
b. An olefin/phosphorus pentasulphide product as antiwear agent
c. The product of an alcohol/phosphorus pentasulphide reaction neutralised with an oil soluble amine as antioxidant
d. a VI improver
e. a mineral oil.

This oil was run in the Petter AV-1 under standard test conditions and the piston was rated in the normal way. The test was then repeated with the addition of 2.5 wt.% of a quaternary ammonium phenate (Example 6) and the two pistons were compared. The test oil containing the quaternary ammonium phenate showed better control of the lacquer deposited on the pistons.

| | Land Lacquer Rating in the Petter AV-1 | |
|---|---|---|
| | No Phenate | Quaternary Ammonium Phenate |
| Land Lacquer | 6.6 | 7.6 |

ii. An oil contained the metal salt of a polyisobutylenesuccinic acid together with a conventional ashless antiwear agent, ashless antioxidant, ashless detergent and VI improver. This oil was run in the MS Vc test under standard conditions and the engine rated in the normal way. The metal salt was then replaced by a quaternary ammonium phenate (Example 6) and the test repeated. The results show that replacing the metal salt with the quaternary salt helps prevent the formation of sludge.

| | MS Vc Results | |
|---|---|---|
| | Metal PIBSA Salt | Quarternary Ammonium Phenate |
| Sludge | 8.0 | 9.2 |
| Varnish | 8.1 | 7.5 |
| Piston skirt varnish | 7.8 | 7.4 |

What is claimed is:

1. A lubricating oil composition comprising a major amount of a mineral or synthetic lubricating oil and a minor amount of a quaternary ammonium salt useful as an oil improving additive, wherein: the cation is derived from the reaction product of a one molar proportion of tertiary amine with one or more molar proportions of an olefin oxide and an amount of water in excess of stoichiometric, the anion is derived from an organic acid, and wherein: said tertiary amine has the formula $R^1R^2R^3N$ where $R^1$, $R^2$ and $R^3$ are the same or different alkyl, cycloalkyl, alkenyl, cycloalkenyl, substituted alkyl, substituted alkenyl, aromatic or substituted aromatic groups, each having 1 to 20 carbon atoms; said olefin oxide has the formula:

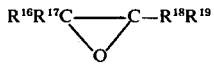

where $R^{16}$, $R^{17}$, $R^{18}$ and $R^{19}$ which may be the same or different are hydrogen atoms, alkyl, cycloalkyl, alkenyl, cycloalkenyl, aromatic or substituted aromatic groups; and wherein said organic acid is selected from the group consisting of carboxylic acid, carboxylic acid anhydride, dialkyldithiophosphoric acid, diaryldithiophosphoric acid, phenols, sulphonic acid, and phosphosulfurized hydrocarbon.

2. A composition according to claim 1 wherein the tertiary amine is a diamine of the formula $R^4R^5N(CH_2)_nNR^6R^7$ where $n$ is an integer of one or more and $R^4$, $R^5$, $R^6$ and $R^7$ are the same or different alkyl, substituted alkyl, cycloalkyl, alkenyl, cycloalkenyl, aromatic or substituted aromatic groups.

3. A composition according to claim 1 wherein the tertiary amine is an alkylated alkylene polyamine of the formula

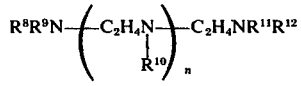

where $n$ is an integer of one or more and $R^8$, $R^9$, $R^{10}$, $R^{11}$ and $R^{12}$ are the same or different alkyl, substituted alkyl, cycloalkyl, alkenyl, cycloalkenyl, aromatic or substituted aromatic groups.

4. A composition according to claim 1 wherein the tertiary amine is pyridine or a substituted pyridine.

5. A composition according to claim 1 wherein the tertiary amine is an amine of the formula

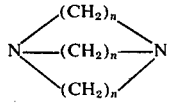

where $n$ is an integer of two or more.

6. A composition according to claim 1 wherein the tertiary amine is hexamethylene tetramine.

7. A composition according to claim 1 wherein the quaternary ammonium salt is derived from a carboxylic acid or a carboxylic acid anhydride.

8. A composition according to claim 7 wherein the acid is an alkyl succinic acid or an alkenyl succinic acid or an anhydride thereof.

9. A composition according to claim 1 wherein the quaternary ammonium salt is derived from a phenol.

10. A composition according to claim 9 wherein the phenol is a monoalkyl phenol.

11. A composition according to claim 1 wherein the quaternary ammonium salt is derived from a methylene bis-phenol of the formula.

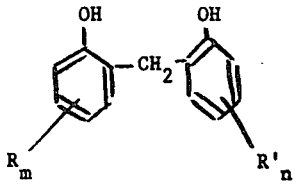

or

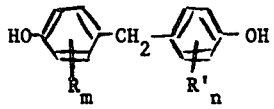

where R and R′ which may be the same or different are hydrogen, an alkyl group, cycloalkyl group, alkenyl group or aromatic group, and *m* and *n* are integers.

12. A composition according to claim 1 wherein the quaternary ammonium salt is derived from a sulphurised phenol of the formula

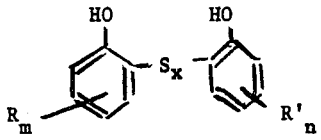

or

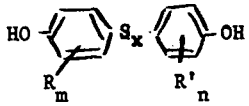

where R and R′ which may be the same or different are hydrogen, an alkyl group, cycloalkyl group, alkenyl group or aromatic group, *m* and *n* are integers and *x* is 1, 2, 3, or 4.

13. A composition according to claim 1 wherein the quaternary ammonium salt is derived from a sulphonic acid.

14. A composition according to claim 13 wherein the sulphonic acid has the formula

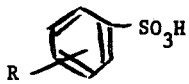

where R is hydrogen, or an alkyl, cycloalkyl, alkenyl, cycloalkenyl, aryl, or a substituted aryl group.

15. A composition according to claim 1 wherein the quaternary ammonium salt is derived from a phosphosulphurised hydrocarbon.

16. A composition according to claim 1 which comprises 0.001 to 10.0% by weight of the quaternary ammonium salt.

* * * * *